US010315173B2

(12) United States Patent
Ikushima

(10) Patent No.: US 10,315,173 B2
(45) Date of Patent: Jun. 11, 2019

(54) MIXING DEVICE, DISCHARGE DEVICE PROVIDED THEREWITH, AND DISCHARGE METHOD

(71) Applicant: MUSASHI ENGINEERING, INC., Mitaka-shi, Tokyo (JP)

(72) Inventor: Kazumasa Ikushima, Mitaka (JP)

(73) Assignee: MUSASHI ENGINEERING, INC., Mitaka-shi, Tokyo (JP)

( * ) Notice: Subject to any disclaimer, the term of this patent is extended or adjusted under 35 U.S.C. 154(b) by 1100 days.

(21) Appl. No.: 14/376,735

(22) PCT Filed: Feb. 4, 2013

(86) PCT No.: PCT/JP2013/052455
§ 371 (c)(1),
(2) Date: Aug. 5, 2014

(87) PCT Pub. No.: WO2013/118673
PCT Pub. Date: Aug. 15, 2013

(65) Prior Publication Data

US 2014/0376328 A1 Dec. 25, 2014

(30) Foreign Application Priority Data

Feb. 7, 2012 (JP) ..... 2012-024165

(51) Int. Cl.
*B01F 13/08* (2006.01)
*B01F 7/00* (2006.01)
(Continued)

(52) U.S. Cl.
CPC ..... *B01F 13/08* (2013.01); *B01F 3/12* (2013.01); *B01F 3/1221* (2013.01);
(Continued)

(58) Field of Classification Search
CPC .. B01F 13/08; B01F 13/0863; B01F 13/0827; B01F 7/00116; B01F 7/00141;
(Continued)

(56) References Cited

U.S. PATENT DOCUMENTS 2,495,895 A 1/1950 Hervert
6,244,741 B1 * 6/2001 Akamine ..... B01F 7/00291 366/307
(Continued)

FOREIGN PATENT DOCUMENTS

JP 45-27958 B1 9/1970
JP 60-140638 U 9/1985
(Continued)

OTHER PUBLICATIONS

Definition of Taper—Merriam-Webster Dictionary (Year: 2018).*
(Continued)

*Primary Examiner* — David C Mellon
*Assistant Examiner* — Liam Royce
(74) *Attorney, Agent, or Firm* — Westerman, Hattori, Daniels & Adrian, LLP

(57) ABSTRACT

Problem: A mixing device is provided which can solve problems resulting from friction between a vessel and a stirrer, which can generate a circulatory flow even below the stirrer, and which allows a desired number of stirrers to be arranged at desired positions. A discharge device provided with the mixing device, and a discharge method are also provided. Solution: The mixing device includes a stirrer incorporating a magnet, a stirrer holding mechanism that specifies a position of the stirrer by exerting a magnetic force on the stirrer from the lateral side, and a rotation mechanism that rotates the stirrer holding mechanism, wherein the rotation mechanism rotates the stirrer holding mechanism, thereby rotating the stirrer. The discharge device includes
(Continued)

the mixing device, and the discharge method is carried out using the discharge device.

16 Claims, 8 Drawing Sheets

(51) Int. Cl.
*B01F 15/02* (2006.01)
*B01F 3/12* (2006.01)

(52) U.S. Cl.
CPC ..... *B01F 7/00116* (2013.01); *B01F 7/00141* (2013.01); *B01F 7/00291* (2013.01); *B01F 7/00633* (2013.01); *B01F 13/0863* (2013.01); *B01F 15/028* (2013.01); *B01F 15/0278* (2013.01); *B01F 15/0279* (2013.01); *B01F 2015/0273* (2013.01)

(58) Field of Classification Search
CPC ..... B01F 7/00291; B01F 7/00633; B01F 7/00708; B01F 7/18; B01F 17/20; B01F 3/12; B01F 3/1221; B01F 15/0278; B01F 15/028; B01F 15/0279; B01F 15/0266; B01F 15/0273; B01F 15/0286; B01F 2015/0273
USPC ..... 366/325.92, 273–274, 328.1, 342–343, 366/184, 189–196
See application file for complete search history.

(56) References Cited

U.S. PATENT DOCUMENTS

| | | | | |
|---|---|---|---|---|
| 6,296,384 | B1 * | 10/2001 | Yatomi | B01F 7/00291 366/147 |
| 6,758,593 | B1 | 7/2004 | Terentiev | |
| 2002/0041537 | A1 | 4/2002 | Yale | |
| 2003/0185096 | A1 * | 10/2003 | Hollstein | B01F 5/10 366/273 |
| 2013/0070555 | A1 | 3/2013 | Akerstrom | |

FOREIGN PATENT DOCUMENTS

| | | | |
|---|---|---|---|
| JP | 62-221427 | A | 9/1987 |
| JP | 2003-144891 | A | 5/2003 |
| JP | 2005-120956 | A | 5/2005 |
| WO | 01/94027 | A2 | 12/2001 |
| WO | 2011/152781 | A1 | 12/2011 |

OTHER PUBLICATIONS

International Search Report dated Apr. 9, 2013, issued in corresponding International application No. PCT/JP2013/052455 (3 pages).
Supplementary European Search Report dated Sep. 4, 2015, issued in counterpart European Patent Application No. 13 74 6864 (2 pages).

* cited by examiner

[Fig.1]
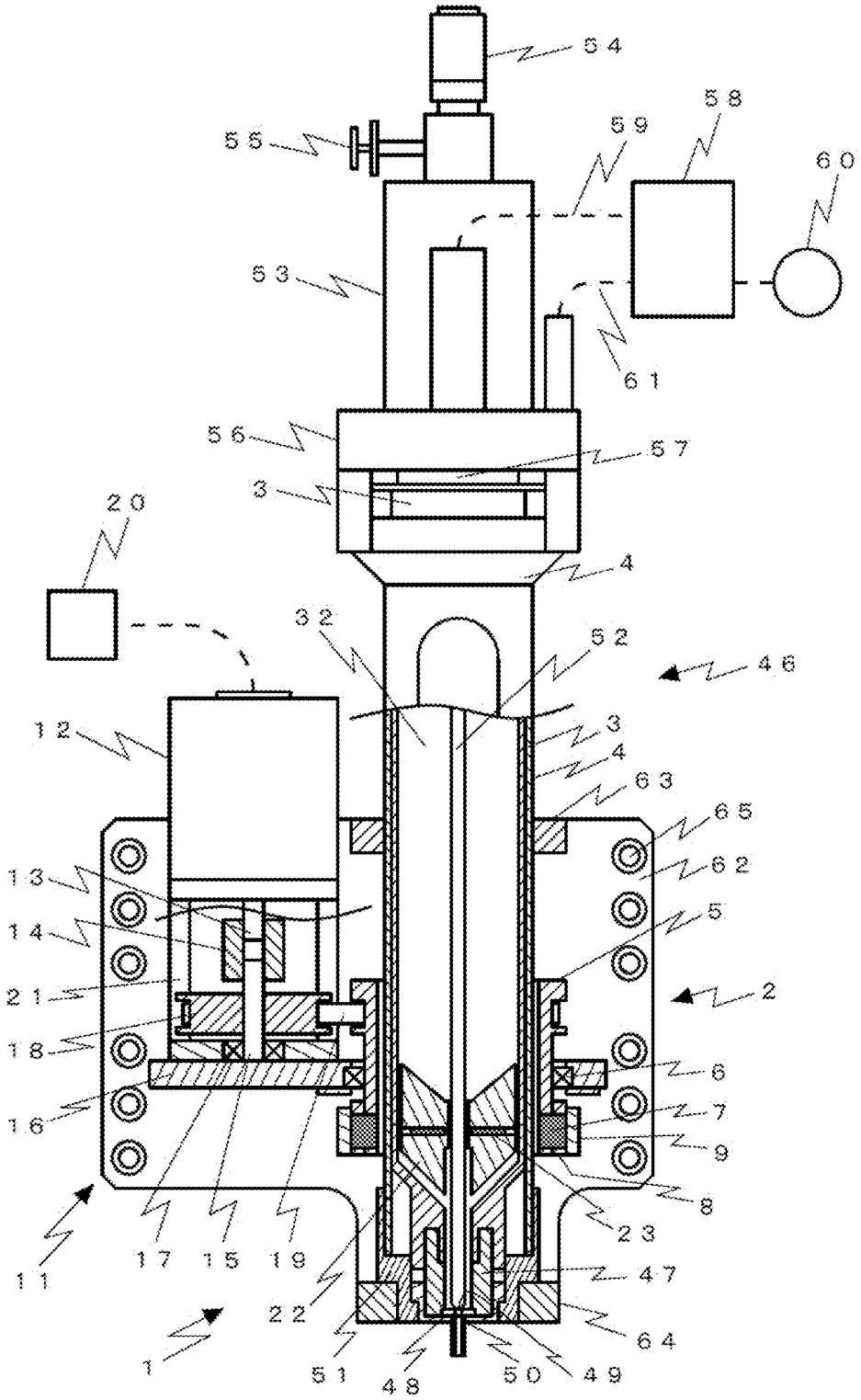

[Fig.2]
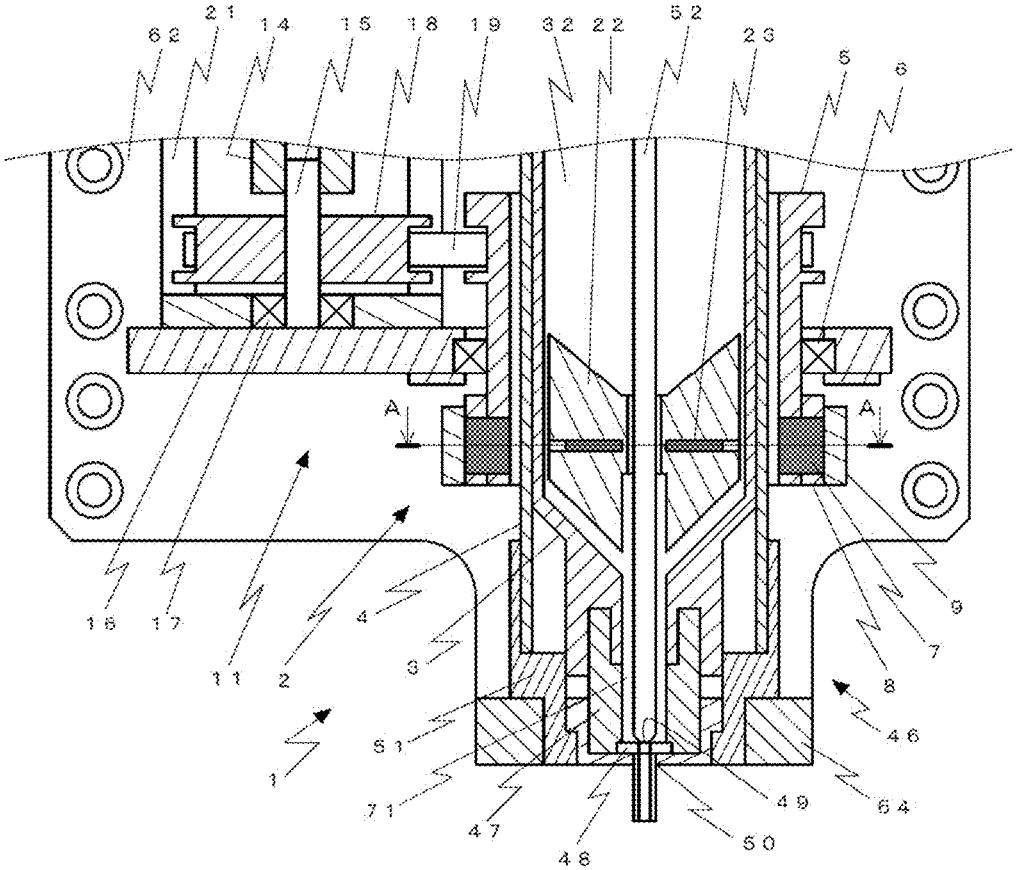

[Fig.3]
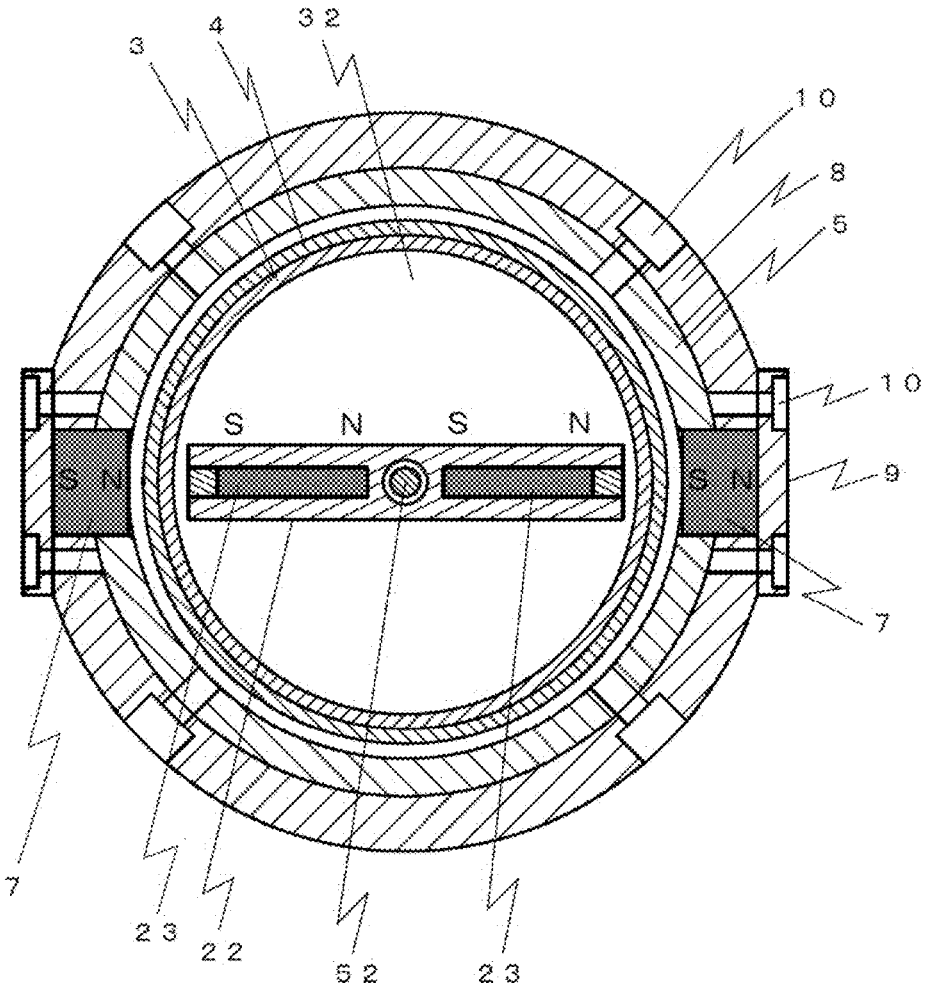

[Fig.4]
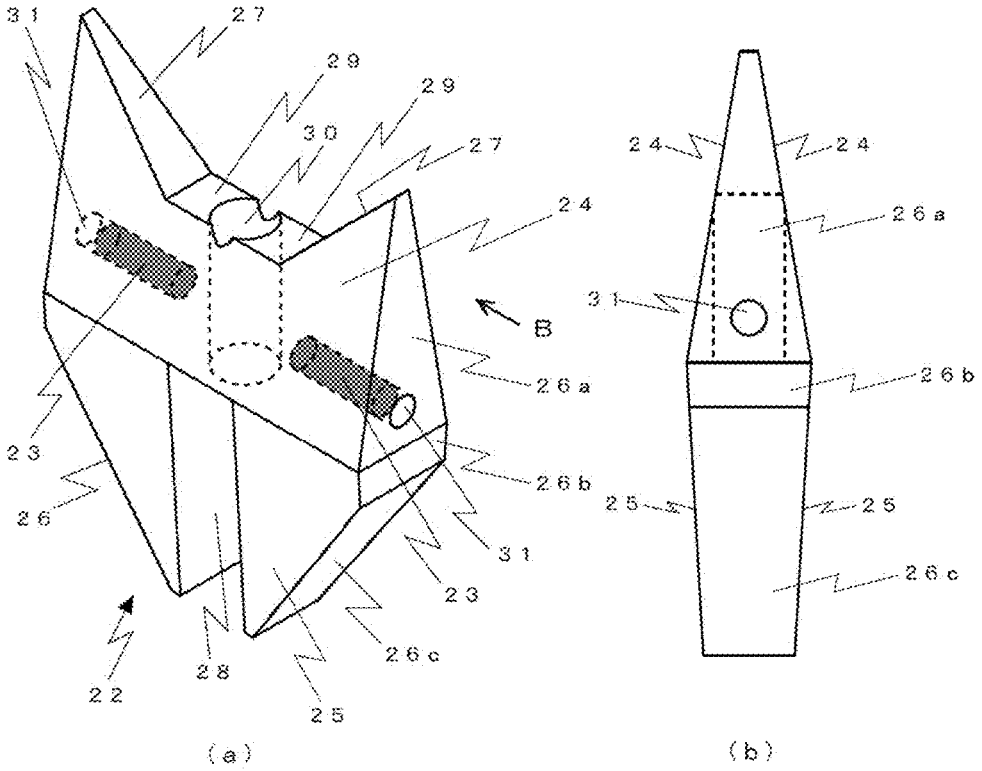

[Fig.5]
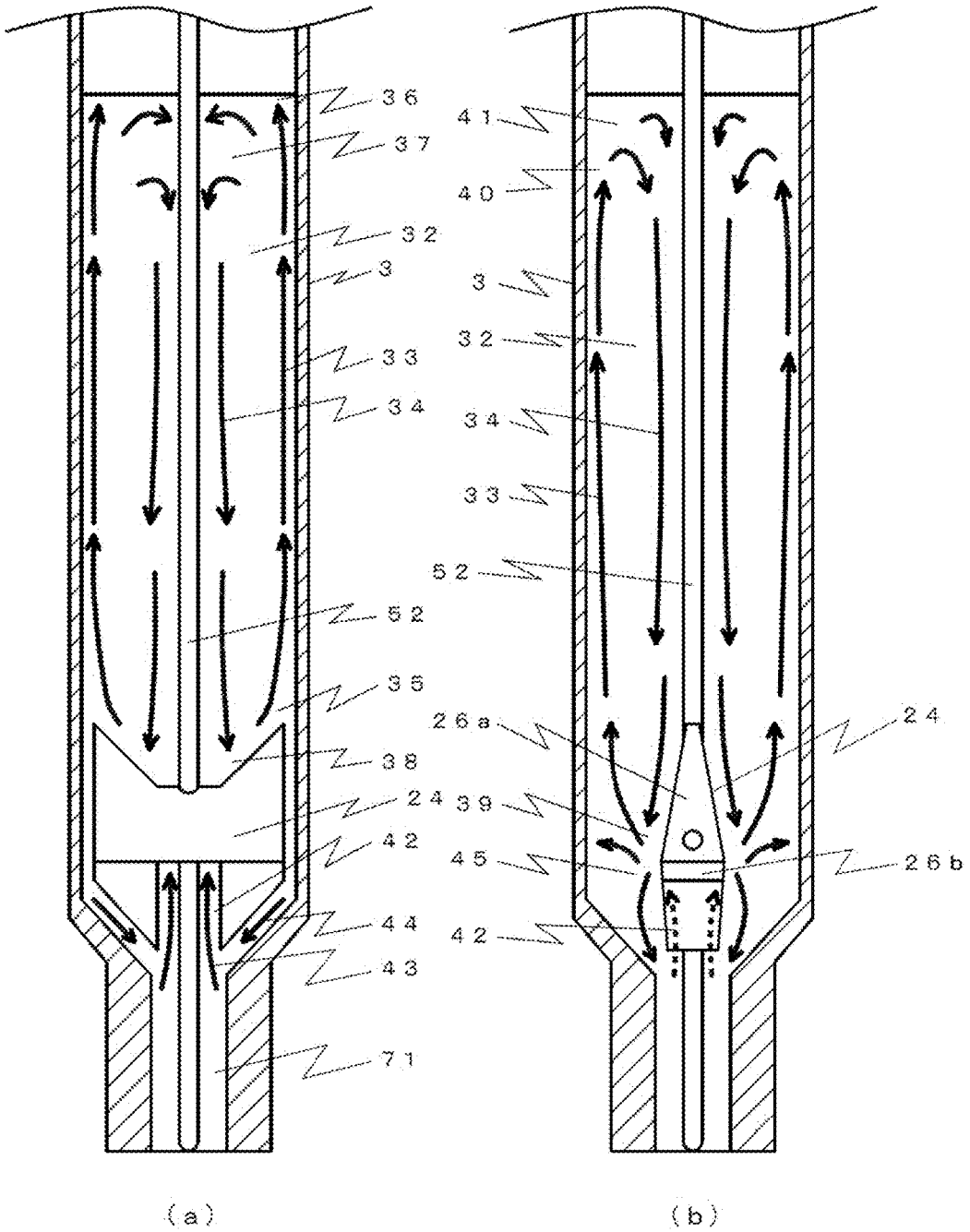

[Fig.6]
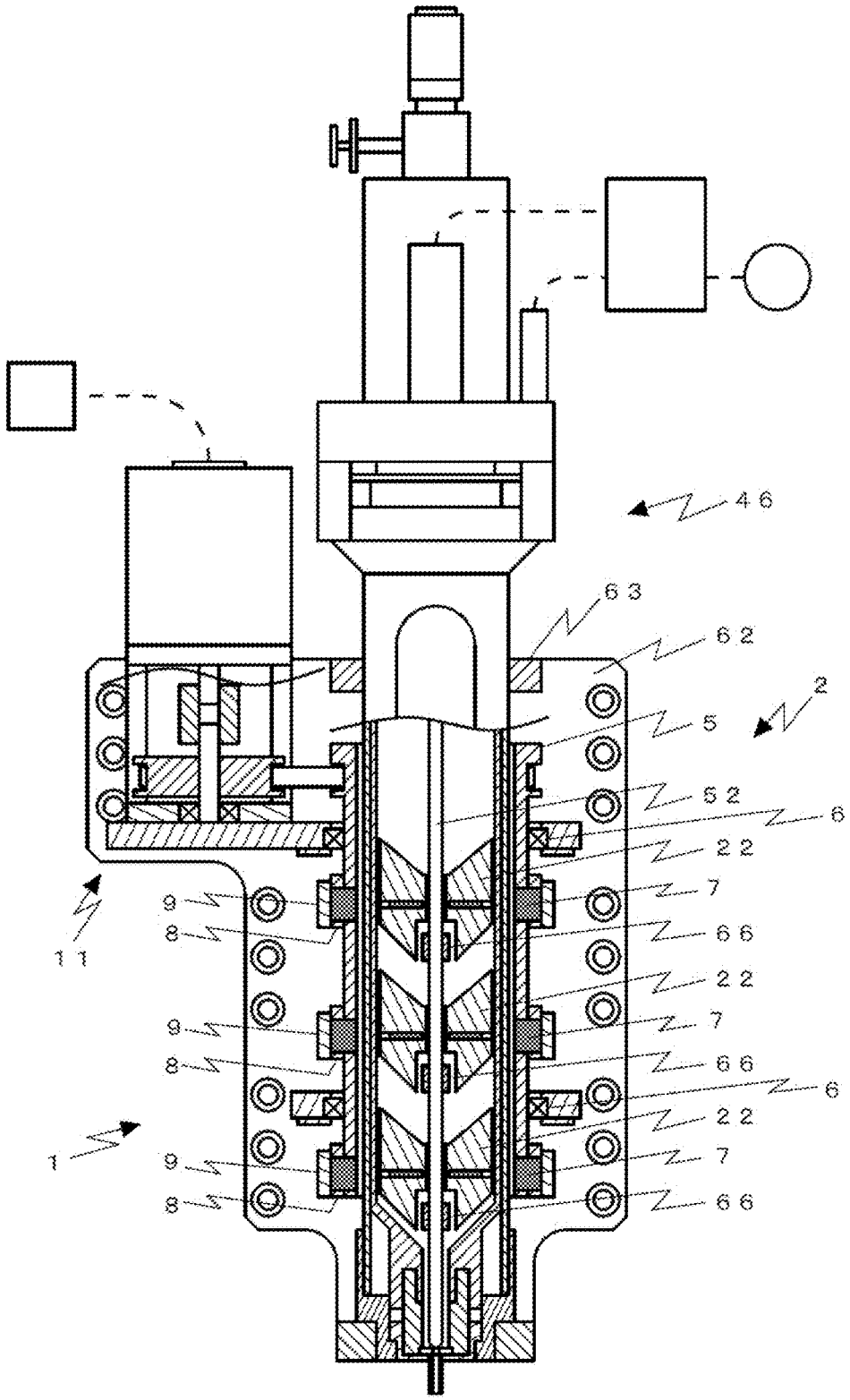

[Fig.7]
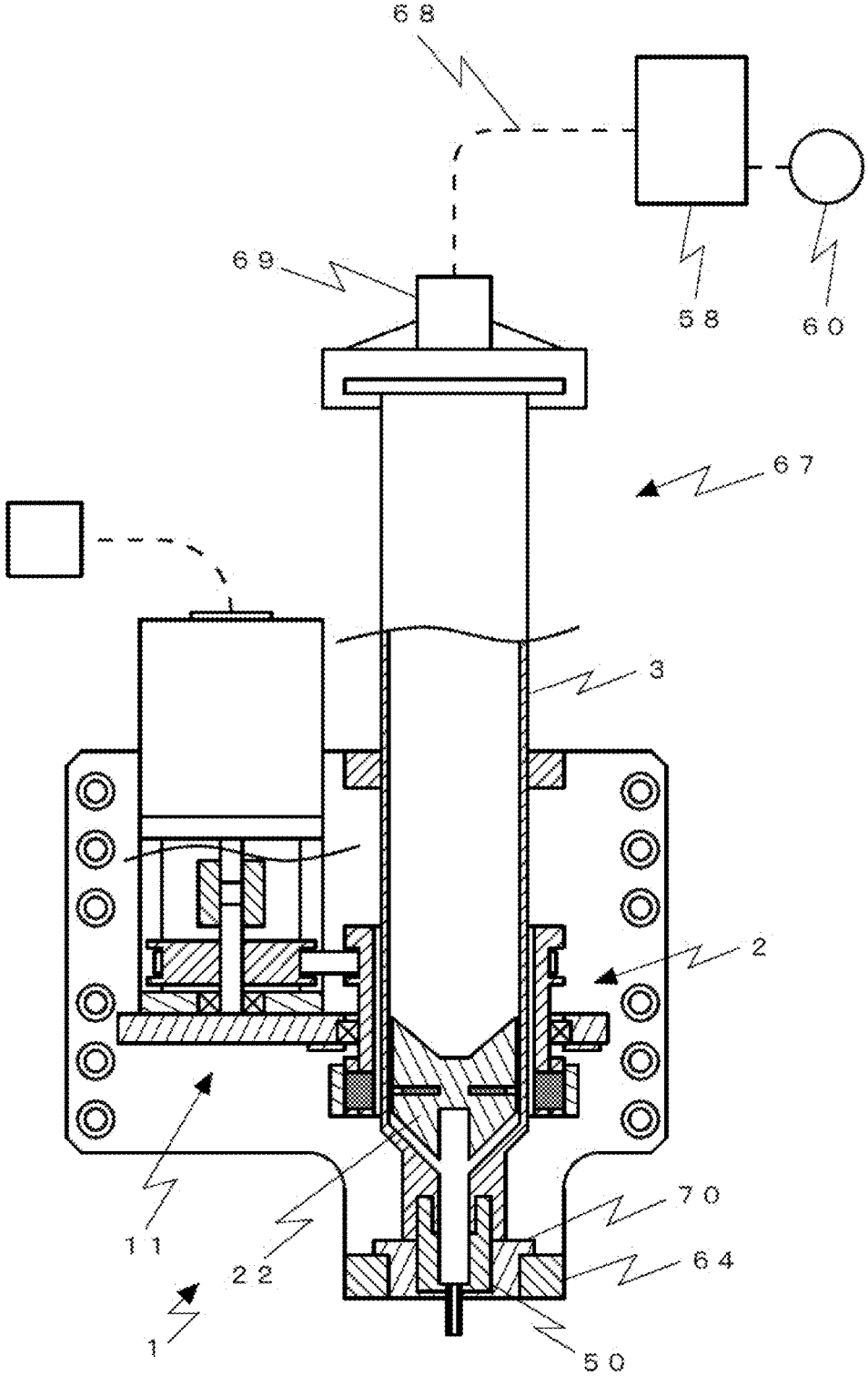

[Fig.8]
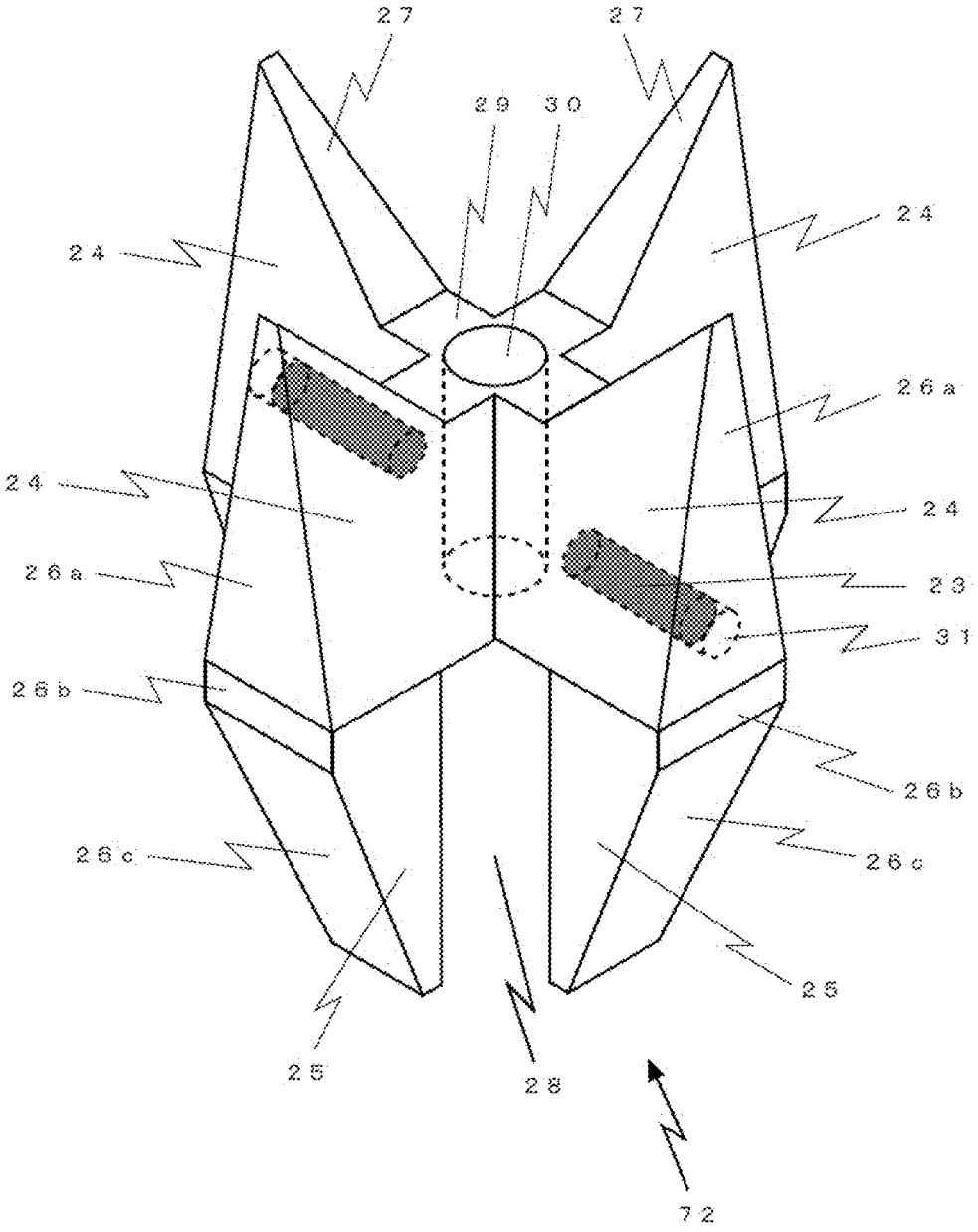

MIXING DEVICE, DISCHARGE DEVICE PROVIDED THEREWITH, AND DISCHARGE METHOD

TECHNICAL FIELD

The present invention relates to a mixing device for stirring a liquid mixed with solid particles and holding a uniformly mixed state, a discharge device provided with the mixing device, and a discharge method.

BACKGROUND ART

In a liquid mixed with solid particles having larger specific gravity than the liquid, it is difficult to hold a uniformly mixed state because the solid particles precipitate with the lapse of time. Holding the uniformly mixed state requires the provision of a mixing device and continuous stirring in a vessel in which the liquid mixed with the solid particles is stored.

As commonly used mixing devices, there are the motor type in which a propeller-like member is disposed at a tip of a rod connected to a motor power shaft and is rotated for mixing in the liquid mixed with the solid particles, and the magnetic force type in which a stirrer incorporating a magnet or a magnetic body is put in the liquid mixed with the solid particles and is rotated for mixing by the action of a magnetic force exerted from the outside of the vessel.

When the liquid mixed with the solid particles is quantitatively discharged and dispensed from the vessel, a discharge device is used which is generally employed to discharge and dispense a liquid material. In the discharge device handling the liquid mixed with the solid particles, however, it is required to one of the various types of mixing devices mentioned above in order to hold the uniformly mixed state. If the liquid mixed with the solid particles is not stirred, a trouble may occur in that the liquid mixed with the solid particles is discharged in a non-uniform state, or that it cannot be discharged because of clogging of a discharge port.

A discharge device provided with a mixing device is disclosed in Patent Document 1, for example. Patent Document 1 discloses a discharge device including a vessel, a stirrer for stirring a liquid, and stirrer rotating means for rotating the stirrer by a magnetic force, wherein the stirrer is arranged at a bottom in the vessel of the discharge device that discharges the liquid, and the stirrer has a through-hole penetrating from an upper surface to a lower surface thereof, a projection is formed in the upper surface, and a groove is formed in the lower surface to communicate an outer peripheral surface of the stirrer with the through-hole.

Another example of the mixing device is disclosed in Patent Document 2. Patent Document 2 discloses a magnetic driving device comprising a drive rotating member, a driven rotating member disposed in opposing relation to the drive rotating member, drive magnets disposed on an opposing surface of the drive rotating member, and driven magnets disposed on an opposing surface of the driven rotating member in the same number as the drive magnets, wherein the drive magnets and the driven magnets have substantially the same shape and are each constituted as a both-surface 2-pole magnet having one magnetic pole formed over one entire lateral peripheral surface and the other magnetic pole formed over the other entire lateral peripheral surface, the drive magnets and the driven magnets are each attached to the corresponding rotating members such that a central extension line passing the opposing surface of the drive magnet and the opposing surface of the driven magnet are parallel to each other, and when the drive rotating member is rotated, the driven rotating member is rotated by a magnetic force. Patent Document 2 further discloses a mixing device in which the above-mentioned magnetic driving device is used as a means for stirring a liquid in the mixing tank.

LIST OF PRIOR-ART DOCUMENTS

Patent Documents

Patent Document 1: Japanese Patent Laid-Open Publication No. 2005-120956

Patent Document 2: Japanese Patent Laid-Open Publication No. 2003-144891

SUMMARY OF THE INVENTION

Problems to be Solved by the Invention

Because the solid particles precipitate, it is generally preferable to dispose the stirrer at the bottom of the vessel, like the device disclosed in Patent Document 1, from the viewpoint of generating convection and promoting the stirring in the vessel. In the device disclosed in Patent Document 1, however, because the stirrer arranged at the bottom of the vessel is rotated by the magnetic force from below externally of the vessel, the stirrer comes into a state pressed against the bottom surface of the vessel by the action of its own dead weight and an attraction force exerted from a magnet. When the stirrer comes into such a state, friction is increased, thus causing various problems, e.g., (1) loss of energy for the rotation, (2) wear of the bottom surface and the shaft bearing portion of the stirrer, (3) mixing of dust and debris, which are caused by the friction, into the liquid, and (4) generation of noise attributable to the friction.

Furthermore, when the magnetic force is exerted on the stirrer through a bottom portion of the vessel, it is difficult to obtain a satisfactory action at the lower side of the stirrer. In Patent Document 1, the groove is formed in the lower surface of the stirrer to generate a flow streaming toward a bottom center of the vessel. This, however, brings about the problem that when the liquid mixed with the solid particles is stirred and flows through the groove having a bent portion, the particles tend to aggregate into masses, thus adversely affecting the discharge.

On the other hand, in the device disclosed in Patent Document 2, which includes a stirring mechanism at the bottom of the vessel, arrangement of the magnets, etc. are designed to reduce a thrust, i.e., a downward force in the direction of a rotation axis, even when a driving force is increased. To support the stirrer (driven rotating member) by a minus thrust (floating force), however, a support shaft has to be disposed at the bottom of the vessel (see FIGS. 4 and 5 in Patent Document 2), or superconducting magnets have to be employed (see FIGS. 6 to 8 in Patent Document 2). Therefore, the bottom shape of the vessel is complicated, or a large-scaled auxiliary device (such as a device for holding a low temperature) is needed. Thus, Patent Document 2 is not suitable for application to the discharge device.

Furthermore, when the magnetic force is exerted on the stirrer from the bottom, a difficulty arises in disposing the desired number of stirrers at the desired positions. In a vessel having a relatively large vertical length, therefore, it is hard to perform stirring over the entire inside of the vessel.

In view of the above-described situation, an object of the present invention is to provide a mixing device, which can solve the problems resulting from friction between a vessel and a stirrer, which can generate a circulatory flow even below the stirrer, and which allows a desired number of stirrers to be arranged at desired positions. Another object is to further provide a discharge device provided with the mixing device, and a discharge method.

Means for Solving the Problems

In the known device constituted to exert the magnetic force on the stirrer from the bottom side of the vessel, it is conceivable, for example, to float the stirrer from the bottom surface of the syringe (vessel) by arranging magnets such that poles having the same polarity are positioned to face each other. However, such a solution has a difficulty in forming a discharge flow passage at a center of the bottom surface of the vessel. The inventor has accomplished the present invention based on the conception of exerting the magnetic force on the stirrer from the lateral side.

According to a first invention, there is provided a mixing device comprising a stirrer incorporating a magnet, a stirrer holding mechanism that specifies a position of the stirrer by exerting a magnetic force on the stirrer from lateral side, and a rotation mechanism that rotates the stirrer holding mechanism, wherein the rotation mechanism rotates the stirrer holding mechanism, thereby rotating the stirrer.

According to a second invention, in the first invention, the stirrer includes a blade having a first acting surface that is widest and that generates flows in a liquid during rotation, and the first acting surface defines a tapered shape gradually narrowing toward an upper end of the blade.

According to a third invention, in the second invention, the blade of the stirrer has a second acting surface that is positioned adjacent to the first acting surface and that generates flows in the liquid during the rotation, and the second acting surface defines a tapered shape gradually narrowing toward a lower end of the blade.

According to a fourth invention, in the second or third invention, the stirrer has a cutout gradually spreading in an upper half thereof.

According to a fifth invention, in any one of the first to fourth inventions, the stirrer has a cutout formed in a lower half thereof.

According to a sixth invention, in the fifth invention, the stirrer has a penetration hole that is communicated with the cutout and that is formed coaxially with the rotary shaft.

According to a seventh invention, in any one of the first to fifth inventions, the stirrer is of two-blade type.

According to an eighth invention, in any one of the first to fifth inventions, the stirrer is of four-blade type.

According to a ninth invention, there is provided a discharge device comprising the mixing device according to any one of the first to eighth inventions, a liquid reservoir to which the stirrer holding mechanism is mounted, a nozzle communicating with the liquid reservoir, a compressed gas source, and a discharge controller that adjusts pressure of compressed gas supplied from the compressed gas source to a desired level and supplies the compressed gas.

According to a tenth invention, there is provided a discharge device comprising the mixing device according to the sixth invention, a liquid reservoir to which the stirrer holding mechanism is mounted, a nozzle communicating with the liquid reservoir, a plunger arranged in the liquid reservoir, and a plunger driving mechanism that reciprocally moves the plunger.

According to an eleventh invention, in the ninth or tenth invention, an inner space of the liquid reservoir has a shape gradually narrowing toward a lower end thereof, and an outer lateral surface of the stirrer defines a gradually narrowing shape while a certain gap is kept between the outer lateral surface and an inner wall of a bottom portion of the liquid reservoir.

According to a twelfth invention, in any one of the ninth to eleventh inventions, the stirrer is constituted by a plurality of stirrers, and the stirrer holding mechanism specifies respective positions of the plural stirrers.

According to a thirteenth invention, there is provided a discharge method using the discharge device according to any one of the ninth to twelfth inventions, wherein the liquid is discharged from the nozzle while the stirrer is rotated at a constant speed.

Advantageous Effects of the Invention

With the present invention, since the stirrer can be arranged at the desired position within the vessel, the problems resulting from friction between the vessel and the stirrer can be solved.

A circulatory flow can be generated even below the stirrer.

In addition, the desired number of stirrers can be arranged at the desired positions.

BRIEF DESCRIPTION OF THE DRAWINGS

FIG. 1 illustrates, in a way partially sectioned in principal parts, a discharge device provided with a mixing device according to a first embodiment.

FIG. 2 is an enlarged sectional view of a portion including the mixing device illustrated in FIG. 1.

FIG. 3 is a sectional view taken along A-A in FIG. 2.

FIG. 4 is an explanatory view to explain a stirrer used in the mixing device according to the first embodiment. Specifically, FIG. 4(*a*) is a perspective view, and FIG. 4(*b*) is a side view looking at the stirrer from a direction denoted by an arrow B in FIG. 4(*a*).

FIG. 5 is a diagrammatic view to explain flows within a vessel when the mixing device according to the first embodiment is used. Specifically, FIG. 5(*a*) illustrates the flows when looking at the vessel from the front side, and FIG. 5(*b*) illustrates the flows when looking at the vessel from the lateral side.

FIG. 6 illustrates, in a way partially sectioned in principal parts, a discharge device provided with a mixing device according to a second embodiment.

FIG. 7 illustrates, in a way partially sectioned in principal parts, a discharge device provided with a mixing device according to a third embodiment.

FIG. 8 is a perspective view to explain a stirrer used in a mixing device according to a fourth embodiment.

MODE FOR CARRYING OUT THE INVENTION

Embodiments for carrying out the present invention will be described below.

First Embodiment (1) Mixing Device

FIG. 1 illustrates, in a way partially sectioned in principal parts, a discharge device provided with a mixing device according to a first embodiment, FIG. 2 is an enlarged sectional view of a portion including the mixing device illustrated in FIG. 1, and FIG. 3 is a sectional view taken along A-A in FIG. 2. FIG. 4 illustrates a stirrer used in the mixing device according to the first embodiment. Specifically, FIG. 4(*a*) is a perspective view, and FIG. 4(*b*) is a side view looking at the stirrer from a direction denoted by an arrow B in FIG. 4(*a*). In the following, the side including a stroke adjustment mechanism 54 in FIG. 1 is called the upper side, and the side including a nozzle 50 is called the lower side in some cases for convenience in explanation.

A mixing device 1 according to this embodiment includes, as main components, a stirrer holding mechanism 2, a rotation mechanism 11, and a stirrer 22.

(Stirrer Holding Mechanism)

The stirrer holding mechanism 2 in this embodiment includes, as main components, a vessel cover 4, an outer tube 5, and a pair of magnets 7.

As illustrated in FIGS. 1 and 2, a vessel 3 in which a liquid 32 mixed with solid particles is to be filled is covered at its outer side with the vessel cover 4 having a cylindrical shape. The vessel 3 and the vessel cover 4 are inserted in the outer tube 5 that is disposed coaxially with the vessel cover 4. A certain gap is kept between the outer tube 5 and the vessel cover 4 such that there occurs no friction between them while the outer tube 5 is rotated. The outer tube 5 is supported by a bearing 6 disposed on a rotation-mechanism supporting member 16, and is rotated by torque transmitted from a torque generator 12 through a belt 19 that is engaged in a groove formed in an upper outer circumference of the outer tube 5. The pair of magnets 7 are fitted in openings that are formed in a lower portion of the outer tube 5 in opposing relation.

As illustrated in FIG. 3, the magnets 7 are fitted in the openings of the outer tube 5 such that one end surface of each magnet is positioned in flush with an inner surface of the outer tube 5. A substantially half of the magnet 7 is fitted in a circumference wall of the outer tube 5, and the remaining half of the magnet 7 is fitted in a magnet supporting member 8 that is fixed to the outer side of the outer tube 5 by fastening members 10. A magnet fixing plate 9 is disposed at an outer end surface of the magnet 7. Because the magnet fixing plate 9 is detachably fixed by the fastening members 10, the relevant component, such as the magnet 7, can be readily attached and detached. Furthermore, the magnet supporting member 8 and the magnet fixing plate 9 are each made of a magnetic material such that they act to attract the magnet and to keep the magnet from moving inwards.

An inner space of the vessel 3 has a gradually narrowing shape. In more detail, a most part of the inner space has a cylindrical shape, but a portion of the inner space, which is connected to a discharge flow passage 71 in communication with a nozzle 50, has a conical shape. A stirrer 22 incorporating a pair of magnets 23 is disposed in the conical portion of the inner space. The above-mentioned magnets 7 are arranged at positions corresponding respectively to the magnets 23 of the stirrer 22 disposed in the vessel 3. In other words, the magnets 7 and the magnets 23 of the stirrer 22 are arranged to lie on one linear line passing a central axis of the vessel 3. Furthermore, respective polarities of the magnets 7 and 23 are arranged in such relation that the magnet 7 and the magnet 23 are attracted to each other (i.e., an attraction force acts between them), as denoted by "S" and "N" in FIG. 3. With such an arrangement, the stirrer 22 can be held at a desired position by a magnetic force in a state suspended in the vessel 3. Therefore, the stirrer 22 can be rotated in a state where a gap is kept between the stirrer 22 and a sloped bottom surface of the vessel 3 without causing contact between them. It is hence possible to prevent the troubles attributable to friction, which have been discussed above.

The gap between the stirrer 22 and the sloped bottom surface of the vessel 3 is preferably set to, for example, about 1/10 to 1/5 of the inner diameter of the vessel 3. With that setting, downward flows caused by the stirrer 22 can be utilized for mixing. In the mixing device 1 of this embodiment, since the magnetic force exerts on the stirrer 22 from the lateral side, the gap between the stirrer 22 and the sloped bottom surface of the vessel 3 can be set freely. In the case of mixing a liquid having high viscosity, magnets generating stronger magnetic forces are disposed in both the stirrer 22 and the outer tube 5.

(Rotation Mechanism)

The rotation mechanism 11 will be described below with reference to FIGS. 1 and 2.

The rotation mechanism 11 in this embodiment includes, as main components, a torque generator 12, a power shaft 13, a coupling 14, a rotary shaft 15, a pulley 18, and a belt 19.

The torque generator 12 is fixed to the rotation-mechanism supporting member 16 with the aid of posts 21. The torque generator 12 may be, for example, an electromotor (motor) such as a servo motor or a stepping motor, an air motor rotated by the action of compressed air, or an ultrasonic motor rotated by the action of an ultrasonic wave, but it is not limited to those examples. The operation of the torque generator 12 is controlled by a mixing controller 20 that is separate from a discharge controller 58 described later.

The torque generated by the torque generator 12 is transmitted, through the power shaft 13, to the rotary shaft 15 that is coupled to the power shaft 13 by the coupling 14. The rotary shaft 15 is rotatably supported by a bearing 17 that is disposed on the rotation-mechanism supporting member 16. The transmitted torque rotates a pulley 18 fixed to the rotary shaft 15. With the rotation of the pulley 18, the torque is transmitted to the outer tube 5 by the belt 19 that is disposed to run around the pulley 18 and the upper part of the outer tube 5. Furthermore, with the rotation of the outer tube 5, the magnets 7 are rotated and the stirrer 22 inside the vessel 3 is then rotated by the magnetic force, thus stirring the liquid 32 mixed with the solid particles in the vessel 3.

While, in the above description, the belt 19 and the pulley 18 are used as a mechanism for transmitting motive power, another mechanism using a combination of a chain and a sprocket, or gears can also be used instead.

(Stirrer)

The stirrer 22 has such a shape as generating circulatory flows on both sides above and under the stirrer 22. To generate the circulatory flow on the upper side, for example, the stirrer 22 includes, in its upper half part, a cutout spreading upwards and giving, to the stirrer 22, a shape gradually narrowing toward its upper end such that a surface acting to generate a flow in the liquid during the rotation (i.e., a widest surface extending vertically and being parallel to a line connecting a rotation axis and an inner circumference wall of the vessel) is tapered upwards. To generate the circulatory flow on the lower side, for example, a lateral surface of the stirrer 22 opposing to a sloped surface of a bottom portion of the vessel 3 is formed as a sloped surface similar to the sloped surface of the bottom portion of the vessel 3, thus giving, to the stirrer 22, a shape gradually narrowing toward its lower end such that a surface acting to generate a flow in the liquid during the rotation (i.e., a surface being parallel to the line connecting the rotation axis and the inner circumference wall of the vessel and being adjacent to the above-mentioned widest surface) is tapered downwards. The stirrer 22 in this embodiment described below has a shape generating the circulatory flows on both the upper and lower sides. For convenience in explanation, a surface of the stirrer opposing to the inner circumferential wall of the vessel and the opposing surface thereof are called outer lateral surfaces, and a surface of the stirrer, which intersect the outer lateral surfaces substantially at a right angle (i.e., a surface being parallel to the line connecting the rotation axis and the inner circumferential wall of the vessel and extending vertically) is called a front surface below.

As illustrated in FIG. 4(*a*), the stirrer 22 in this embodiment is of the two-blade type including two blades disposed on both sides of the rotation axis. The stirrer 22 is obtained by forming tapered surfaces 24 and 25, upper cutout surfaces 27, outer lateral surfaces 26, a lower cutout 28, a penetration hole 30, and holes 31 in a plate-like member having a relatively large thickness. The stirrer 22 has a shape like the feather of an arrow, as illustrated in FIG. 1, when looking at the stirrer from the front. A widest flat surface generating flows in the liquid during the rotation is provided by the upper tapered surface 24 (of which right half or left half with the rotation axis interposed between them serves as an acting surface). A flat surface disposed adjacent to the upper tapered surface 24 on the lower side thereof provides the lower tapered surface 25 (of which right half or left half with the rotation axis interposed between them serves as an acting surface). When looking at the stirrer 22 from a direction facing the outer lateral surface thereof, the stirrer 22 has a shape obtained by joining respective long sides of a trapezoid having a steep taper and a trapezoid having a moderate taper to each other through an outer lateral surface 26*b* interposed between the two trapezoids. The reason why the tapered surfaces 24 and 25 are formed as mentioned above is that greater flows can be generated in comparison with the case of not forming those tapered surfaces. Because a steeper tapered surface generates a greater flow, the upper tapered surface 24 serving to mix a larger amount of liquid is formed as a steeper sloped surface. To be adapted for forward and backward rotations, the tapered surfaces 24 and 25 are preferably formed at the rear side as well such that the stirrer has a left-right symmetric shape when viewed from the direction facing the outer lateral surface.

A lower portion of the stirrer 22 (i.e., a portion of the stirrer 22 below the outer lateral surface 26*b*) is formed to have outer lateral surfaces 26*c* such that a width between the outer lateral surfaces 26*c* is gradually narrowed downwards in conformity with the shape of the bottom portion of the vessel 3. Moreover, at a center of the lower portion of the stirrer 22 in the widthwise direction thereof, the lower cutout 28 having a rectangular shape is form to extend from a lower end of the stirrer up to a position corresponding to about a half height of the stirrer (i.e., up to an upper end of the outer lateral surface 26*b*). A width of the lower cutout 28 is set equal to or slightly larger than the diameter of the penetration hole 30. With that setting, a flow can be generated in a gap between a plunger 52 and the lower cutout 28 as well. A stopper 66 described in a later-described second embodiment may be disposed.

On the other hand, in an upper portion of the stirrer 22 (i.e., a portion above the outer lateral surface 26*b*), a flat portion 29 defining a surface parallel to a horizontal plane is formed at a position corresponding to about ¼ of the height descending from an upper end of the stirrer. The penetration hole 30 is formed at a center of the flat portion 29. Furthermore, the upper cutout surfaces 27 are formed to obliquely extend from opposite ends of the flat portion 29 up to the upper end of the stirrer while approaching the outer lateral surfaces. The stirrer 22 having the upper portion formed as described above can generate a stronger rising flow within the vessel 3.

The penetration hole 30 has a diameter allowing the plunger 52 of a later-described discharge device 46 to operate through the penetration hole 30, i.e., preferably about 1.5 to 2 times the diameter of the plunger. Moreover, at a position slightly above the outer lateral surface 26*b*, a pair of holes 31 are formed to extend perpendicularly to the penetration hole 30 toward the center from the outer lateral surfaces, and the magnets 23 are fitted in the holes 31, respectively. The hole 31 in which the magnet 23 is fitted has a depth not reaching the penetration hole 30. A length of the magnet 23 is set shorter than the depth of the hole 31, and a vacant portion of the hole 31 after fitting the magnet 23 is sealed off to fix the magnet. At that time, preferably, the holes 31 are closed such that an outer lateral surface 26*a* including each hole 31 becomes a flat surface, in order to prevent the solid particles from adhering to and being solidified in a recess, etc. Thus, it is possible to avoid the liquid 32 mixed with the solid particles from entering the inside of the stirrer 22, and to facilitate maintenance work such as cleaning.

(2) Flows within Vessel

FIG. 5 diagrammatically illustrates flows within the vessel when the stirrer in this embodiment is actually rotated. Specifically, FIG. 5(*a*) illustrates the flows within the vessel when looking at the stirrer from the front side, and FIG. 5(*b*) illustrates the flows within the vessel when looking at the stirrer from the lateral side.

First, the flows on the upper side of the stirrer 22 are described. As illustrated in FIG. 5(*a*), when looking at the stirrer from the front side, a rising flow 35 generated near the upper end of the upper cutout surface 27 of the stirrer 22 rises along the inner circumferential wall of the vessel 3 and straightly reaches the vicinity of a liquid surface (denoted by symbol 36). Thereafter, the flow 36 turns to a falling flow 37 near the plunger 52 at the center of the vessel 3, and flows downwards to the stirrer 22 along the central side of the vessel 3 (denoted by symbol 38).

As illustrated in FIG. 5(*b*), when looking at the stirrer from the lateral side, a rising flow generated near the outer lateral surface 26*b* of the stirrer 22 (denoted by symbol 39) rises along the inner circumferential wall of the vessel 3 and straightly reaches a height slightly under the liquid surface (denoted by symbol 40). Such a height is substantially the same level at the height at which the flow toward the center appears (denoted by symbol 37) when looking at the stirrer from the front side. Thereafter, the flow 40 turns to a falling flow (denoted by symbol 41) while involving the liquid near the liquid surface, and flows downwards to the vicinity of a boundary defined by the outer lateral surface 26*b* of the stirrer 22 (denoted by symbol 39).

Thus, it is understood that circulatory flows are generated above the stirrer 22 by the stirrer 22 having the upper cutout surfaces 27 and the upper tapered surfaces 24. With those circulatory flows, the liquid 32 mixed with the solid particles, which is present above the stirrer 22, can be uniformly mixed.

Next, the flows on the lower side of the stirrer 22 are described. As illustrated in FIG. 5(*a*), when looking at the stirrer from the front side, a rising flow 42 is generated in the lower cutout 28, and it rises while withdrawing a part of the liquid in the discharge flow passage 71 together (denoted by symbol 43). To compensate for such a rising flow, a falling flow 44 is generated in the gap between the stirrer 22 and the sloped bottom surface of the vessel 3. As illustrated in FIG. 5(*b*), when looking at the stirrer from the lateral side, a falling flow 45 is generated near the outer lateral surface 26*b* of the stirrer 22. A rising flow 42 denoted by dotted lines in FIG. 5(*b*) are the above-mentioned flows in the lower cutout 28.

Thus, it is understood that circulatory flows are generated under the stirrer 22 by the stirrer 22 having the lower cutout 28 and the lower tapered surfaces 25. It is further understood that the gap between the stirrer 22 and the sloped bottom surface of the vessel 3 also contributes to generating those circulatory flows. With those circulatory flows, the liquid 32 mixed with the solid particles, which is present under the stirrer 22, can be uniformly mixed.

According to the above-described stirrer 22 in this embodiment, the circulatory flows can be generated in both the upper and lower sides of the stirrer, and the solid particles dispersed in the liquid within the vessel can be stirred into a uniformly mixed state.

(3) Discharge Device

The mixing device 1 of this embodiment is suitably applied to a discharge device 46 that quantitatively discharges and dispenses the liquid 32 mixed with the solid particles from the vessel 3. The mixing device 1 is particularly suitable for application to a plunger type discharge device in which a liquid is discharged by opening and closing the discharge port with operation of the plunger 52. The structure and the operation of the discharge device 46 provided with the mixing device 1 of this embodiment will be described below with reference to FIGS. 1 and 2.

(Structure)

The discharge device 46 includes the vessel (syringe) 3 that stores the liquid 32 mixed with the solid particles. A tip of the syringe 3 is fitted to a connecting member 47 that includes a flow passage constituting a part of the discharge flow passage 71. A valve seat 48 and a tubular nozzle 50 are disposed in a portion of the connecting member 47, the portion defining a distal end of the discharge flow passage 71. The valve seat 48 and the nozzle 50 are supported by a nozzle fixing member 51. The nozzle fixing member 51 is fixed by screwing to the vessel cover 4 that covers the syringe 3. The valve seat 48 has a communication hole 49 formed at a center thereof, and the syringe 3 and the nozzle 50 are communicated with each other through the communication hole 49. The plunger 52 extending through the penetration hole 30 of the stirrer 22 is disposed within the vessel 3. The plunger 52 is operated to advance and retreat by a plunger driving mechanism 53 in such a manner that the plunger 52 closes and opens the communication hole 49 of the valve seat 48.

A mechanism for specifying a most advanced position of the plunger 52 may be disposed to abruptly stop the plunger immediately before the plunger abuts against the valve seat, thus discharging droplets in a flying fashion.

The plunger driving mechanism 53 includes a stroke adjusting mechanism 54 that adjusts a stroke of the plunger 52, i.e., a distance through which the plunger is moved, and a fixing screw 55 that fixedly maintains the adjusted stroke. The plunger driving mechanism 53 is connected to an adapter 56 and is mounted by inserting an inserted portion 57 of the adapter into an upper opening end of the syringe 3 and by fixing the adapter 56 and the vessel cover 4 together. The operation of the plunger driving mechanism 53 is controlled by a discharge controller 58 connected thereto via a control wiring line 59. The discharge controller 58 adjusts pressure of compressed gas supplied from a compressed gas source 60 to a desired level, and then supplies the compressed gas to the syringe 3 through a compressed gas pipe 61.

The discharge device 46 is supported by an upper vessel supporting member 63 and a lower vessel supporting member 64, which are fixed to a base 62. On that occasion, the discharge device 46 is supported in a state where a certain gap is kept relative to the outer tube 5 of the mixing device 1 that is also fixed to the base 62. Fixing holes 65 used to fix the base 62 to, e.g., an XYZ driving mechanism or a stationary stand (not illustrated) by fastening members are formed in the base 62 at plural positions.

(Operation)

The discharge device 46 constituted as described above operates as follows.

A state where the tip of the plunger 52 is abutted against the valve seat 48 and the communication hole 49 is closed is assumed to be an initial state. In the initial state, the stirrer 22 is rotated to start stirring. When a discharge start signal is transmitted from the discharge controller 58, the plunger driving mechanism 53 is operated to ascend the plunger 52. A distance through which the plunger 52 is ascended at that time is determined by the stroke adjusting mechanism 54. When the plunger 52 is ascended and the communication hole 49 of the valve seat 48 is opened, the liquid 32 mixed with the solid particles in the syringe 3 is caused to flow into the nozzle 50 by the action of the compressed gas. The liquid 32 mixed with the solid particles, having flowed into the nozzle 50, passes through a flow passage in the nozzle and is then ejected to the outside from the discharge port. At that time, the liquid 32 mixed with the solid particles is in a state still connecting to a tip of the nozzle 50 (i.e., a state where the connection to the nozzle tip needs to be cut). When a discharge end signal is transmitted from the discharge controller 58 after the lapse of a predetermined time, the plunger driving mechanism 53 is operated to descend the plunger 52. When the plunger 52 is descended to abut against the valve seat 48 and the communication hole 49 of the valve seat 48 is closed, the liquid 32 mixed with the solid particles in the syringe 3 is caused to depart from the tip of the nozzle 50 and to fly in the form of a droplet. During the above-mentioned process, the stirrer 22 is rotated at a constant speed.

The foregoing is the basic operation to perform one cycle of discharge. The above-described basic operation is repeated when performing plural cycles of discharge.

Second Embodiment

A second embodiment relates to a discharge device including a plurality of stirrers. Such a discharge device is suitable for the case where the vessel (syringe) communicating with the nozzle has a large capacity, or the case using a liquid mixed with particles that tend to precipitate.

In a mixing device 1 according to this embodiment, a plurality of stirrers can be disposed in the lengthwise direction of the syringe 3 and can be rotated because magnetic forces are exerted on the syringe 3 from the lateral side instead of being exerted on the syringe 3 from below. FIG. 6 illustrates, in a way partially sectioned in principal parts, the discharge device provided with the mixing device according to the second embodiment. In the following, only different features from those in the first embodiment are described, and duplicate description of the same features is omitted.

The mixing device 1 according to this embodiment includes three stirrers 22 disposed within the vessel 3 at certain intervals. When the stirrer 22 is disposed plural, the corresponding magnet 7 and magnet fixing member have to be also disposed plural. Therefore, this embodiment uses the outer tube 5, which has a length sufficient to cover a region corresponding to the three stirrers 22, and which is equipped with three sets of magnets 7, magnet supporting members 8, and magnet fixing members 9. Correspondingly, the rotation mechanism 11 is disposed at an upper position than in the first embodiment.

While the bearing 6 supporting the outer tube 5 may be disposed at one position on the side near the stirrer holding mechanism 2, it is preferably disposed at two positions, as illustrated in FIG. 6, so that more stable rotation can be obtained. Stoppers 66 may be disposed on the plunger 52 at certain intervals to avoid the stirrers 22 from being contacted with each other within the vessel 3. The stoppers 66 are fixed to the plunger 52 to be not rotatable. Between an upper end of each stopper 66 and the stirrer 22, a gap is kept to such an extent as providing a distance longer than the intended stroke from the viewpoint of not impeding the discharge operation. The interval between the stirrers 22 is preferably about 0.5 to 1.5 times the inner diameter of the vessel 3. With such an arrangement, flows can be generated above and under each of the stirrers 22, and uniform mixing can be ensured. While the stirrers 22 are arranged in a coaxially aligned state (i.e., a state where the stirrers are completely overlapped with each other when viewed from above) in this embodiment, the stirrers 22 may be arranged in a state shifted from one another at a certain angle (e.g., 60 degrees).

With the above-described discharge device 46 according to this embodiment, discharge work can be performed while solid particles are uniformly mixed in a liquid, even in the case where the vessel (syringe) communicating with the nozzle has a large capacity, or the case using a liquid mixed with particles that tend to precipitate.

Third Embodiment

A third embodiment relates to an air type discharge device that discharges a liquid in the vessel (syringe) 3 by the action of compressed gas. FIG. 7 illustrates, in a way partially sectioned in principal parts, the discharge device provided with a mixing device according to the third embodiment. In the following, only different features from those in the first embodiment are described, and duplicate description of the same features is omitted.

A discharge device 67 according to this embodiment does not include the plunger 52 and the components associated with the plunger, and it includes, as main components, the vessel 3, the nozzle 50, the discharge controller 58 that adjusts pressure of the compressed gas supplied from the compressed gas source 60 to a desired level and then supplies the compressed gas, and the adapter 69 that supplies the compressed gas under the adjusted pressure to the vessel 3 through a tube 68. The discharge device 67 discharges the liquid by applying the compressed gas under the adjusted pressure to the liquid in the vessel for a predetermined time.

The discharge device 67 is supported by a nozzle guide 70 that is disposed on the lower vessel supporting member 64. Because there is no plunger 52, the penetration hole 30 is not required to be formed in the stirrer 22. However, the penetration hole 30 may be formed to generate the flow passing through the penetration hole 30.

With the above-described discharge device 67 according to this embodiment, discharge work can be performed for a liquid material that is not suitable for discharge using the plunger, while solid particles are uniformly mixed in the liquid material.

Fourth Embodiment

A fourth embodiment relates to a discharge device including a four-blade type stirrer. FIG. 8 is a perspective view to explain the stirrer used in a mixing device according to the fourth embodiment. In the following, only different features from those in the first embodiment are described, and duplicate description of the same features is omitted.

As illustrated in FIG. 8, a stirrer 72 includes four blades that are positioned in opposing relation in two pairs about the penetration hole 30 at the center. Thus, the stirrer 72 has a crossed form when viewed from above. As in the two-blade type stirrer 22 in the first embodiment, the each blade has the tapered surfaces 24 and 25, the upper cutout surfaces 27, the outer lateral surfaces 26, the lower cutout 28, the penetration hole 30, the flat portion 29, and the holes 31.

Flows generated by the stirrer 72 are basically similar to the flows (FIG. 5) generated by the stirrer 22. However, since the number of locations where the flows are generated are increased from two to four, finer flows can be generated in a state divided in a larger number, and the solid particles dispersed in the liquid within the vessel can be stirred into a more uniformly mixed state.

While the hole 31 and magnet 23 are each disposed in one pair in this embodiment, two pairs of holes 31 and magnets 23 may be disposed when a greater magnetic force is required depending on the weight of the stirrer itself or the viscosity of the liquid, etc.

While the four-blade type stirrer is disclosed in this embodiment, a three-blade type stirrer may also be used depending on the use.

INDUSTRIAL APPLICABILITY

The present invention is practiced in the following uses, for example:

- application to form a film of a dry lubricant (solid lubricant)
- application to form a phosphor layer in an LED module

LIST OF REFERENCE SYMBOLS

1: mixing device 2: stirrer holding mechanism 3: vessel (syringe) 4: vessel cover 5: outer tube 6: bearing (for outer tube) 7: magnet (for outer tube) 8: magnet supporting member 9: magnet fixing plate 10: fastening member (for outer tube) 11: rotation mechanism 12: torque generator 13: power shaft 14: coupling 15: rotary shaft 16: rotation-mechanism supporting member 17: bearing (for rotary shaft) 18: pulley 19: belt 20: mixing controller 21: post 22: stirrer 23: magnet (for stirrer) 24: upper tapered surface 25: lower tapered surface 26: outer lateral surface 27: upper cutout surface 28: lower cutout 29: flat portion 30: penetration hole 31: hole 32: liquid mixed with solid particles 33 to 45: flows 46: discharge device 47: connecting member 48: valve seat 49: communication hole 50: nozzle 51: nozzle fixing member 52: plunger 53: plunger driving mechanism 54: stroke adjusting mechanism 55: fixing screw 56: adapter 57: inserted portion of adapter 58: discharge controller 59: control wiring line 60: compressed gas source 61: compressed gas pipe 62: base 63: upper vessel supporting member 64: lower vessel supporting member 65: hole for fixing 66: stopper 67: air type discharge device 68: tube 69:

adapter (air type) 70: nozzle guide 71: discharge flow passage 72: stirrer S: S pole of magnet N: N pole of magnet

The invention claimed is:

1. A mixing device comprising:

at least one stirrer incorporating a magnet;

a stirrer holder that specifies a position of the stirrer by exerting a magnetic force on the stirrer from a lateral side; and a rotator to rotate the stirrer holder, wherein the stirrer includes a blade having an upper portion and a lower portion, the upper portion is formed in a shape such that a thickness of the blade linearly decreases toward an upper end of the blade, and the lower portion is formed in a shape such that a thickness of the blade linearly decreases toward a lower end of the blade, the rotator rotates the stirrer holder, thereby rotating the stirrer, an outer lateral surface of the lower portion of the blade has a shape gradually narrowing toward the lower end of the blade such that a width of the blade decreases toward the lower end of the blade, the blade comprises two blades disposed on both sides of a rotation axis, and the two blades have an upper cut out gradually spreading in an upper half of the blade.

2. The mixing device according to claim 1, wherein the two blades have a lower cutout formed in a lower half thereof.

3. The mixing device according to claim 2, wherein the stirrer has a penetration hole that is communicated with the lower cutout and that is formed coaxially with a shaft.

4. The mixing device according to claim 1, wherein the stirrer is of two-blade type.

5. The mixing device according to claim 1, wherein the stirrer is of four-blade type.

6. The mixing device according to claim 3, wherein the stirrer is of two-blade type.

7. The mixing device according to claim 3, wherein the stirrer is of four-blade type.

8. A discharge device comprising:

the mixing device according to claim 1;

a liquid reservoir to which the stirrer holder is mounted;

a nozzle communicating with the liquid reservoir;

a compressed gas source; and a discharge controller that adjusts pressure of compressed gas supplied from the compressed gas source to a desired level and supplies the compressed gas.

9. A discharge device comprising:

the mixing device according to claim 3;

a liquid reservoir to which the stirrer holder is mounted;

a nozzle communicating with the liquid reservoir;

a plunger arranged in the liquid reservoir; and a plunger driver that reciprocally moves the plunger.

10. The discharge device according to claim 8, wherein an inner space of the liquid reservoir has a shape gradually narrowing toward a lower end thereof, and the outer lateral surface of the lower half part of the blade defines a gradually narrowing shape while a certain gap is kept between the outer lateral surface and an inner wall of a bottom portion of the liquid reservoir.

11. The discharge device according to claim 9, wherein an inner space of the liquid reservoir has a shape gradually narrowing toward a lower end thereof, and the outer lateral surface of the lower half part of the blade defines a gradually narrowing shape while a certain gap is kept between the outer lateral surface and an inner wall of a bottom portion of the liquid reservoir.

12. The discharge device according to claim 8, wherein the at least one stirrer is constituted by a plurality of stirrers, and the stirrer holder specifies respective positions of the plural stirrers.

13. The discharge device according to claim 9, wherein the at least one stirrer is constituted by a plurality of stirrers, and the stirrer holder specifies respective positions of the plural stirrers.

14. A discharge method using the discharge device according to claim 8, wherein the liquid is discharged from the nozzle while the stirrer is rotated at a constant speed.

15. A discharge method using the discharge device according to claim 9, wherein the liquid is discharged from the nozzle while the stirrer is rotated at a constant speed.

16. The mixing device according to claim 1, wherein the thickness of the upper portion of the blade linearly decreases toward the upper end of the blade, and the thickness of the lower portion of the blade linearly decreases toward the lower end of the blade such that each of the upper portion of the blade and the lower portion of the blade has no portion parallel to the axis with respect to a thickness direction.

* * * * *